US006351922B1

(12) United States Patent
Burns et al.

(10) Patent No.: US 6,351,922 B1
(45) Date of Patent: Mar. 5, 2002

(54) SINGLE-END WALL TIE

(75) Inventors: William S. Burns; Kenneth G. Banks, both of Weston (CA)

(73) Assignee: Blok-Lok Limited, Weston (CA)

( * ) Notice: Subject to any disclaimer, the term of this patent is extended or adjusted under 35 U.S.C. 154(b) by 0 days.

(21) Appl. No.: 09/715,100

(22) Filed: Nov. 20, 2000

(51) Int. Cl.[7] ..... E04B 2/30

(52) U.S. Cl. ..... 52/713; 52/565; 52/568; 52/379; 52/383

(58) Field of Search ..... 52/712, 713, 565, 52/568, 379, 383

(56) References Cited

U.S. PATENT DOCUMENTS

| | | | | |
|---|---|---|---|---|
| 779,268 A | | 1/1905 | Elliott | |
| 1,946,732 A | | 1/1934 | Danielson | |
| 3,277,626 A | | 10/1966 | Brynjolfsson | |
| 3,300,939 A | * | 1/1967 | Brynjolfsson et al. | 52/713 |
| 3,377,764 A | * | 4/1968 | Storch | 52/713 |
| 4,852,320 A | * | 8/1989 | Ballantyne | 52/379 X |
| 5,454,200 A | * | 10/1995 | Hohmann | 52/513 |
| 5,490,366 A | | 2/1996 | Burns et al. | |
| 6,279,283 B1 | * | 8/2001 | Hohmann et al. | 52/513 |

* cited by examiner

*Primary Examiner*—Beth A. Stephan
*Assistant Examiner*—Brian E. Glessner
(74) *Attorney, Agent, or Firm*—Arne I. Fors

(57) ABSTRACT

An adjustable wall tie for securing together spaced wythes such as a masonry veneer wall to a structural masonry wall of block-like construction. The wall incudes a tension anchor and a generally J-shaped single-ended hook adapted to engage the tension for vertical adjustment.

4 Claims, 4 Drawing Sheets

SINGLE-END WALL TIE

BACKGROUND OF THE INVENTION (i). Field of the Invention

This invention relates to an anchoring and tying device and, more particularly, relates to a vertically adjustable wall tie for securing together spaced wythes such as a masonry veneer wall to a structural masonry wall of block-like construction.

(ii). Description of the Related Art

Common residential and commercial building construction practice entails forming a brick or other masonry veneer wall adjacent a structural inner supporting wall. Generally the masonry veneer is spaced apart from the structural inner wall in a construction technique known as cavity wall construction. The air gap deters the formation and build up of damaging moisture on the structural inner wall as well as providing some thermal and acoustic insulation.

Anchors or ties are required to span the air gap at predetermined locations to secure the masonry veneer to the inner structural wall. Anchors are often formed integral with the structural wall where said structural wall is of masonry block construction. Vertically adjustable ties are required where the mortar joints of the veneer wall do not align with the the mortar joints of the structural block wall.

In the prior art it is known to use metallic elements for affixing masonry veneers to inner structural walls. U.S. Pat. No. 779,268 issued Jan. 3, 1905 discloses a combination of anchoring and tying components for use with block like members having grooves in their meeting edges. Right angled or 'T' shaped flanges formed in the anchor and tie members engage grooves in mating blocks to fixedly attach a facing wall to the support wall. This disclosure provides little vertical adjustment of the ties and is not suitable for standard bricks and blocks.

U.S. Pat. No. 1,946,732 issued Feb. 13, 1934 discloses a device for securing masonry veneer walls to structural masonry support walls. A single vertical rod is disposed on the outer face of a support wall block by means of right angularly extended end portions embedded in the mortar joints over and under said block. A bonding member attached to the vertical rod is embedded in a mortar joint of the masonry veneer. In this disclosure the vertical rod, having a length substantially the same as the relatively large standard construction block, provides ample vertical adjustment but may provide inadequate horizontal support if the bonding member is placed in the central region of the vertical rod.

In U.S. Pat. No. 3,277,626 issued Oct. 11, 1966 a double shank adjustable wall tie is disclosed for tying together spaced wythes consisting of a structural wall and a veneer wall. A planar "U" shaped anchor having loops formed in the free ends is disposed in the horizontal PG,4 mortar joint of the structural wall with said loops extending outward. A tie member secured in a mortar joint of the veneer wall has a base piece and a pair of outwardly extending generally parallel arms, each of said arms having a transversely turned finger at the free end thereof. Said fingers are adapted to engage the loops of the anchor member for securement of the veneer wall to the structural wall. Limited vertical adjustment is provided wherein the bond strength is decreased as engagement of the fingers in the loops decreases. For a commercially available anchor and tie device similar in principle and application to this disclosure it is recommended that vertical adjustment not exceed 11/2" from the tension tie anchor to avoid possible failure by bending.

U.S. Pat. No. 5,490,366 issued Feb. 13, 1996 discloses an adjustable doubleend hook tie device for securing together a masonry veneer wall and a structural masonry wall.

It is a principal object of the present invention to provide a new and improved single end hook anchoring and tying device which may be used in residential or commercial construction employing standard masonry bricks and blocks or the like.

It is a further object of the present invention to provide enhanced vertical adjustment of the tie member with improved lateral strength and retention properties.

SUMMARY OF THE INVENTION

In its broad aspect, an adjustable wall tie of the present invention for securing spaced wythes together, each formed of courses of preformed block or brick having cementing means for joining the courses together and defining a space therebetween, comprises a rectangular tension anchor having a base member and a pair of substantially parallel longitudinal side members extending from said base member perpendicular thereto, a transverse end member parallel to the base member joining the distal ends of the side members together, and an intermediate transverse member attached to the side members in proximity to said end member forming an elongated transverse slot therebetween, said tension anchor being adapted to be positioned whereby the base member can be cemented in one of said wythes with the opposite end member with transverse slot disposed in the space between the wythes; and a generally J-shaped single-ended hook having laterally spaced longitudinal side sections and a transverse-end section joining one end of the longitudinal side sections together to form a planar base, and the opposite end of the longitudinal side sections bent at substantially 90° to the planar base and having short perpendicular side sections reverse bent substantially 90° parallel to the planar base and spaced therefrom, and a transverse section joining the reverse bent side sections together to form a restraining hook, whereby the planar base may be positioned in and cemented in the other of the wythes with the short perpendicular side sections disposed in the space between the wythes and the restraining hook extending through the slot of the tension anchor for tying said wythes together.

The restraining hook may be turned up or down to extend vertical adjustment of the wall tie.

BRIEF DESCRIPTION OF THE DRAWINGS

The single-end hook wall tie of the present invention will now be described with reference to the accompanying drawings, in which.

DESCRIPTION OF THE PREFERRED EMBODIMENTS

Figure 1:
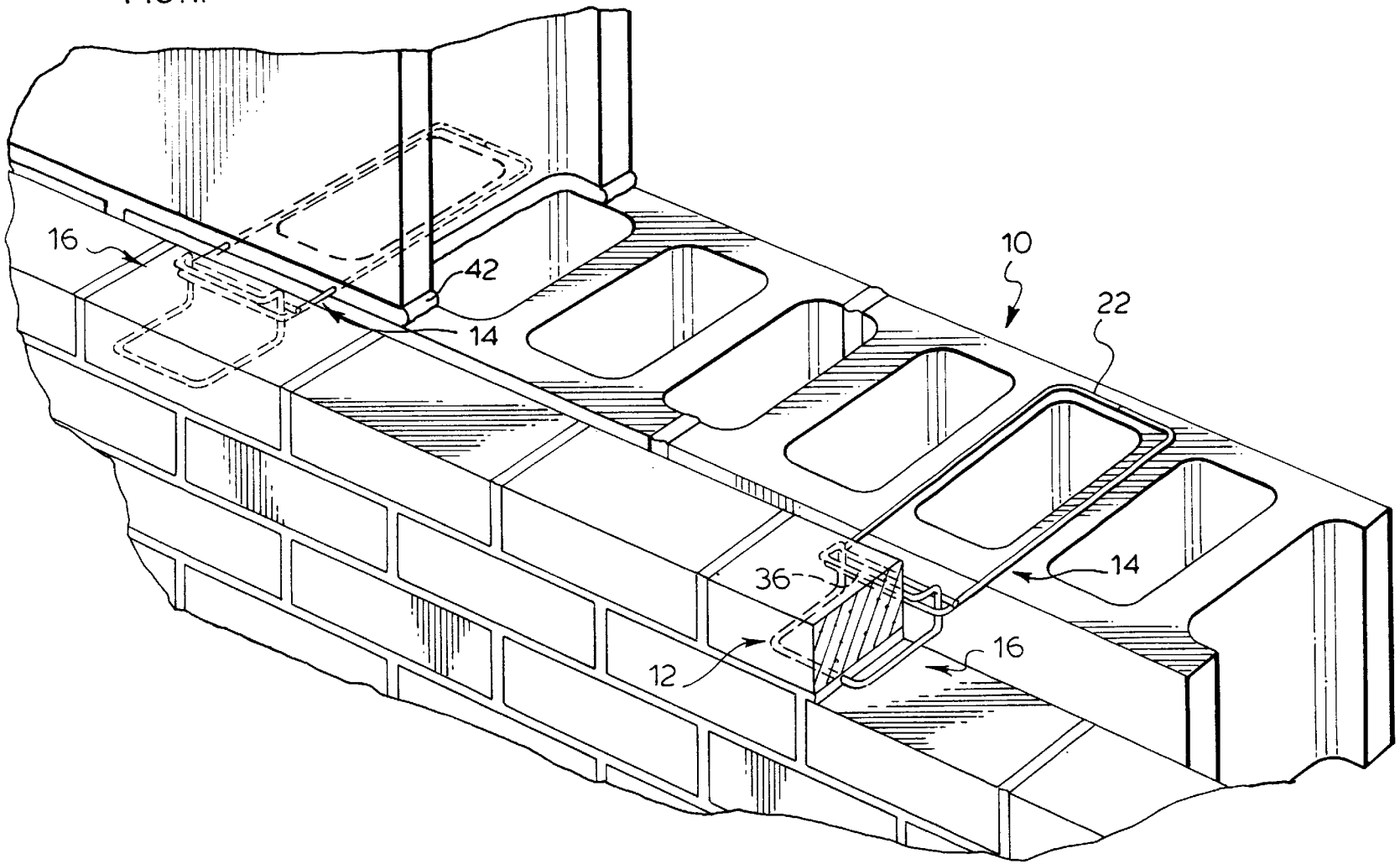
FIG. 1 is a perspective view of a typical veneer wall construction employing an embodiment of the wall tie of the invention embedded in a mortar joint.
Figure 2:
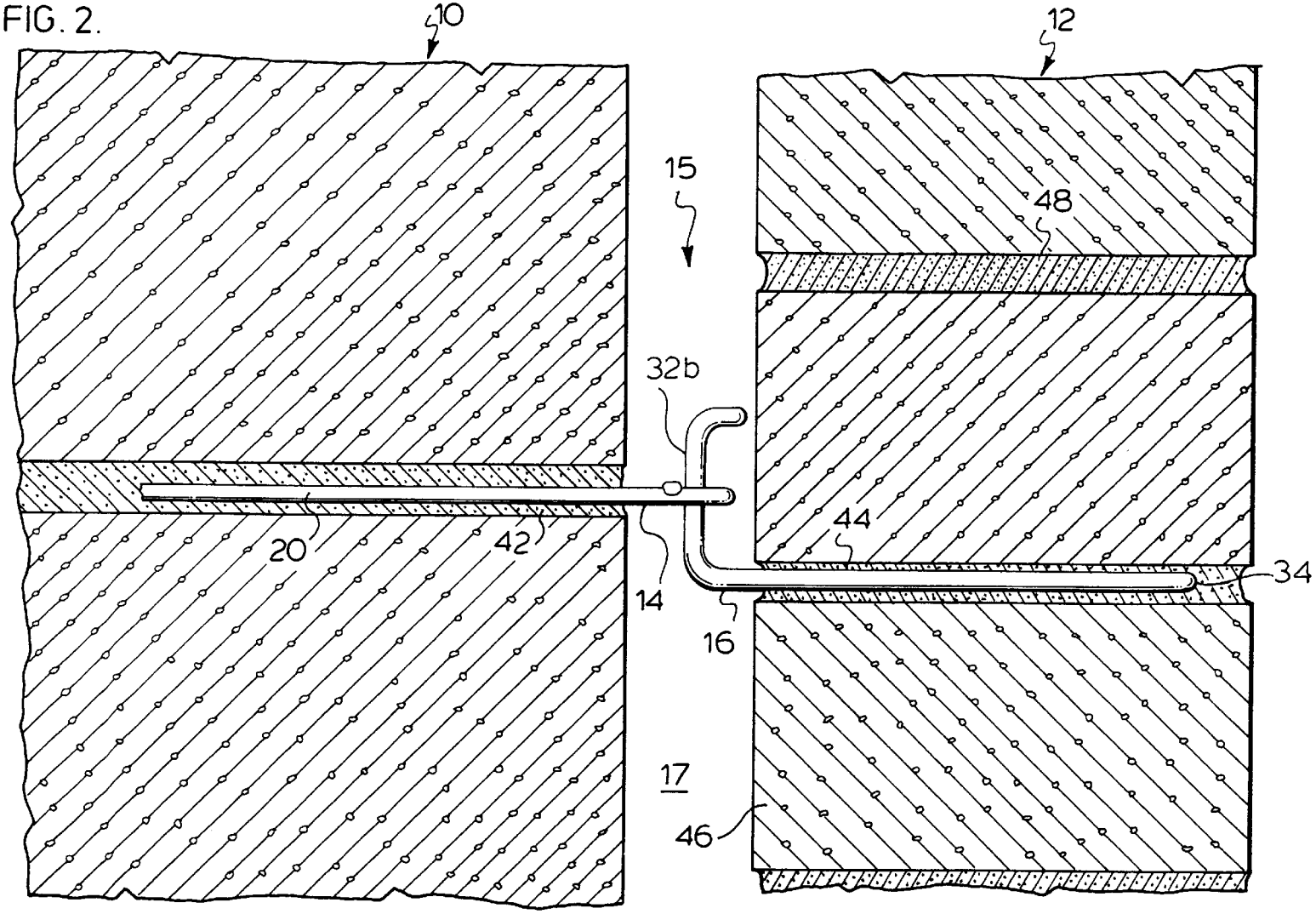
FIG. 2 is a side elevation, partly in section, of the wall tie shown in FIG. 1.

With reference to FIGS. 1 and 2 there is shown a typical residential or commercial masonry wall comprising a pair of wythes consisting of a structural block wall 10 and a substantially parallel brick veneer wall 12, spaced laterally therefrom. A tension anchor 14, interconnected with a single-ended hook 16, forms a wall tie 15 which spans the air gap 17 to secure said brick veneer wall 12 to the structural block wall 10.

Figure 3:
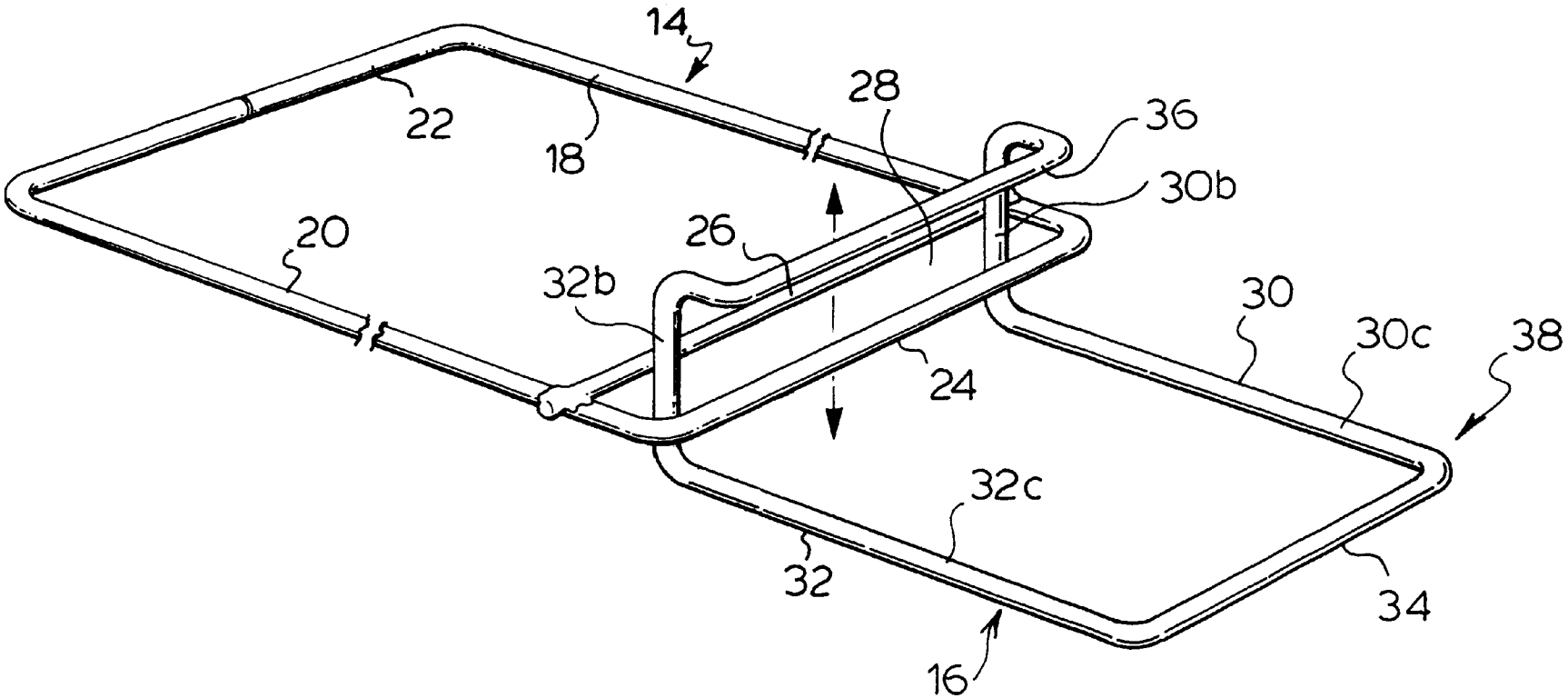
FIG. 3 is a perspective view of the anchor and tie components of the said wall tie in engagement according to the present invention.

Referring now to FIG. 3 of the drawings, the tension anchor 14 and single-end hook 16 of the present invention are shown. The tension anchor is a generally rectangular member of heavy wire stock metal having a pair of substantially parallel longitudinal side members 18 and 20, connected at opposing ends thereof by substantially parallel end cross members 22 and 24. An intermediate cross member 26 is fixedly attached to opposing longitudinal members 18 and 20 in close proximity and substantially parallel to cross member 24 forming an elongated opening or slot 28 therein. The longitudinal side members 18, 20 are substantially coplanar and perpendicular with the cross end members 22, 24 and 26.

The single-end hook 16 of the present invention comprises a generally rectangular, J-shaped closed loop of heavy wire stock metal having longitudinal side sections 30 and 32 joined at one end by transverse base leg 34. The longitudinal side sections 30 and 32 are bent at right angles to form short vertical legs 30*b* and 32*b* and reverse bent again at right angles to form transverse base leg 36 joining the opposite ends of side sections 30, 32 to form a hook.

Transverse base members 34 and 36 defining the width of hook 16 are of a length slightly less than the length of the elongated slot 28 of the tension anchor 14 to allow insertion of transverse leg 36 of single-end hook 16 through said elongated slot 28.

Referring again also to FIGS. 1 and 2, in the fabrication of masonry walls wherein the adjustable wall ties of the present invention are employed, tension anchors 14 are embedded in horizontal mortar joints 42 of the structural wall 10 during erection. Longitudinal members 18 and 20 of the tension anchor 14 extend outward into the air gap 17, so as to expose the elongated slot 28 for engagement of the base leg 36 of the single-end hook 16 therein. Spacing of said tension anchors 14 is determined by building code specifications or other building requirements. Vertical spacing for standard brick veneer construction can range from 2 ¼" to 16" in height.

As the brick veneer wall is erected, single-end hook ties 16 are inserted through the elongated slots 28 of embedded tension anchor ties 14. The lower extension 38 of the single-end hook tie 16 is shown embedded in a horizontal mortar joint 44 on the lower side of a course of bricks 46. The vertical members 30*b* and 32*b* and base leg 36 are slidingly disposed in slot 28 with the hook facing upwardly to tie the wythes together as a unit.

Figure 4:
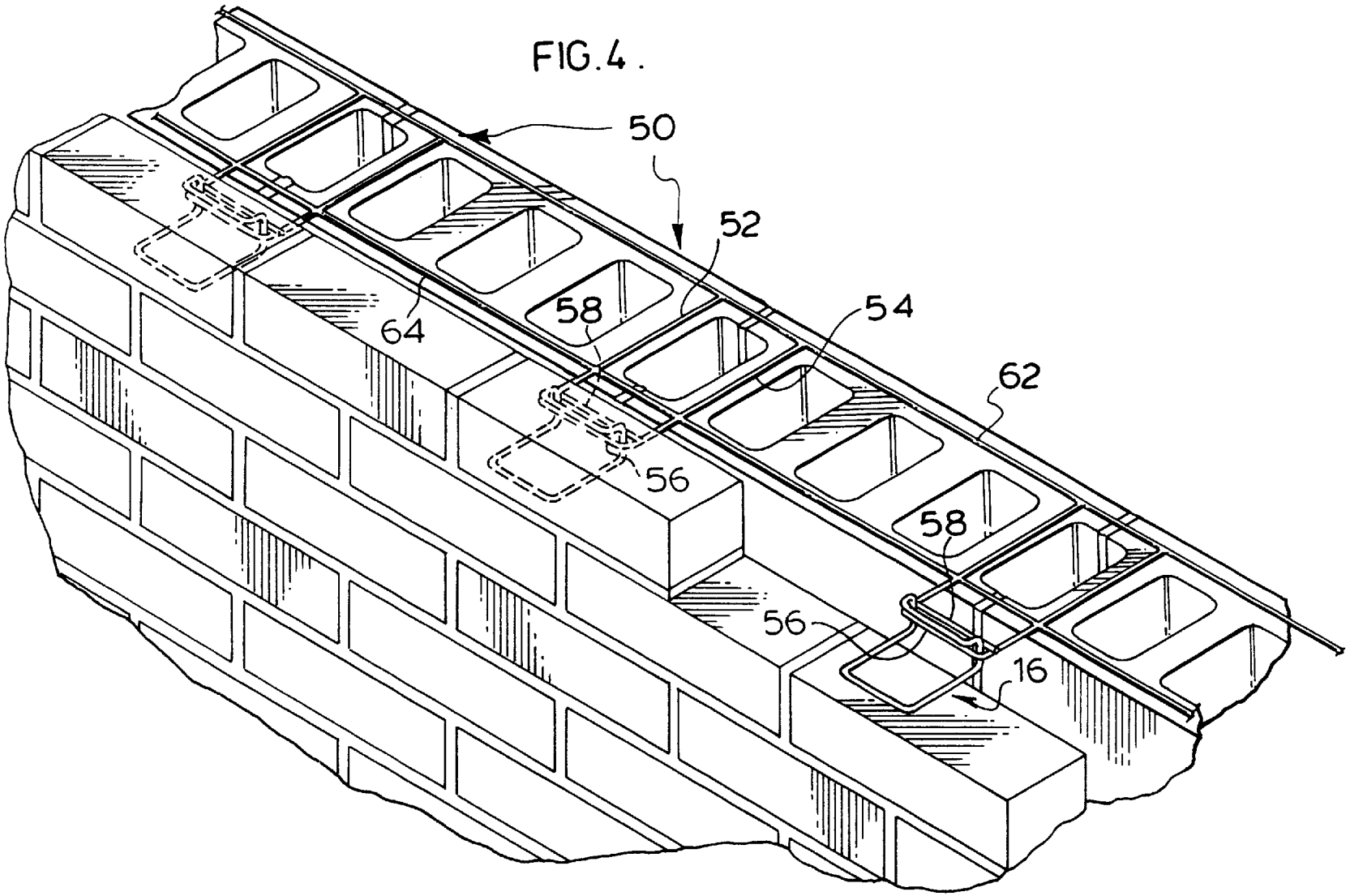
FIG. 4 is a perspective view of a further embodiment of the hook tie of the invention.

FIG. 4 illustrates another embodiment of the invention in which each tension anchor 50 comprises longitudinal side members 52 and 54 connected at one end by end members 56 and spaced parallel intermediate cross member 58 to define a slot therebetween and connected at the opposite end by elongated base wire 62. An elongated second wire 64 parallel to and spaced from wire 62 may be connected to side members 52 and 54, base wire 62 and intermediate wire 64 uniformly spacing a plurality of anchors 50 from each other for ease of installation. In this embodiment, the hook 16 faces upwardly, but may face downwardly.

The adjustable wall tie of the present invention provides advantages over the prior art. The single-end hook is simple to manufacture and easy to install. The single-end hook can be used either side up so that vertical adjustment is extended and may be applied to a masonary veneer of any reasonable dimension.

It will be understood, of course, that modifications can be made in the embodiment of the invention illustrated and described herein without departing from the scope and purview of the invention as defined in the appended claims.

What is claimed is:

1. An adjustable wall tie for securing spaced wythes together, each formed of courses of preformed block or brick having cementing means for joining the courses together and defining a space therebetween, comprising a rectangular tension anchor having a base member and a pair of substantially parallel longitudinal side members extending from said base member perpendicular thereto, a transverse end member parallel to the base member joining the distal ends of the side members together, and an intermediate transverse member attached to the side members in proximity to said end member forming an elongated transverse slot therebetween, said tension anchor being adapted to be positioned whereby the base member can be cemented in one of said wythes with the opposite end member with transverse slot disposed in the space between the wythes; and a generally J-shaped single-ended hook having laterally spaced longitudinal side sections forming a planar base and the opposite ends of the longitudinal side sections bent at substantially 90° to the planar base and having short perpendicular side sections reverse bent substantially 90° parallel to the planar base and spaced therefrom, and a transverse section joining the reverse bent side sections together to form a restraining hook, the planar lower extension being adapted and positioned whereby the planar base may be positioned in and cemented in the said wythe with the short perpendicular side section disposed and terminating in the space between the wythes and extending through the slot of the tension anchor for tying said wythes together.

2. An adjustable wall tie as claimed in claim 1 in which the tension anchor and the single ended hook are formed of heavy wire stock metal.

3. An adjustable wall tie as claimed in claim 2 in which the tension anchor base member is an elongated wire having a plurality of equispaced pairs of substantially parallel longitudinal side members having distal ends extending perpendicular therefrom and a transverse end member parallel to the elongated wire joining the distal ends of the side members together.

4. An adjustable wall tie as claimed in claim 3 in which an intermediate elongated wire parallel to and spaced from the elongated base wire is connected to the plurality of equipspaced pairs of substantially parallel longitudinal side members.

* * * * *